United States Patent [19]

Stoltz

[11] 4,314,427

[45] Feb. 9, 1982

[54] INTERNAL PIPE CLEANING APPARATUS UTILIZING FLUENT ABRASIVE

[76] Inventor: Woodrow W. Stoltz, P.O. Box 35103, Tulsa, Okla. 74135

[21] Appl. No.: 104,426

[22] Filed: Dec. 17, 1979

[51] Int. Cl.[3] ..... B24C 3/32

[52] U.S. Cl. ..... 51/411

[58] Field of Search ..... 51/411, 436; 134/166 C, 134/167 C, 168 C, 169 C; 118/317

[56] References Cited

U.S. PATENT DOCUMENTS

| | | | |
|---|---|---|---|
| 2,358,557 | 9/1944 | Boyd | 51/411 |
| 3,071,107 | 1/1963 | Stanley | 118/317 X |
| 3,902,276 | 9/1975 | Jarvis | 51/411 |
| 4,064,293 | 12/1977 | Nicklas | 51/411 X |
| 4,181,092 | 1/1980 | Johnson | 51/411 X |

*Primary Examiner*—Gary L. Smith

*Attorney, Agent, or Firm*—Head and Johnson

[57] ABSTRACT

Apparatus adapted to move longitudinally through a pipe section and comprising a rotatable head member for impinging sand, grit, or other abrasive materials against the inner periphery of the pipe at a high pressure for cleaning thereof, and including a conduit for directing the sand into the interior of the rotatable head in a manner substantially precluding the leakage of the sand from the apparatus prior to discharge thereof from the rotating head.

6 Claims, 1 Drawing Figure

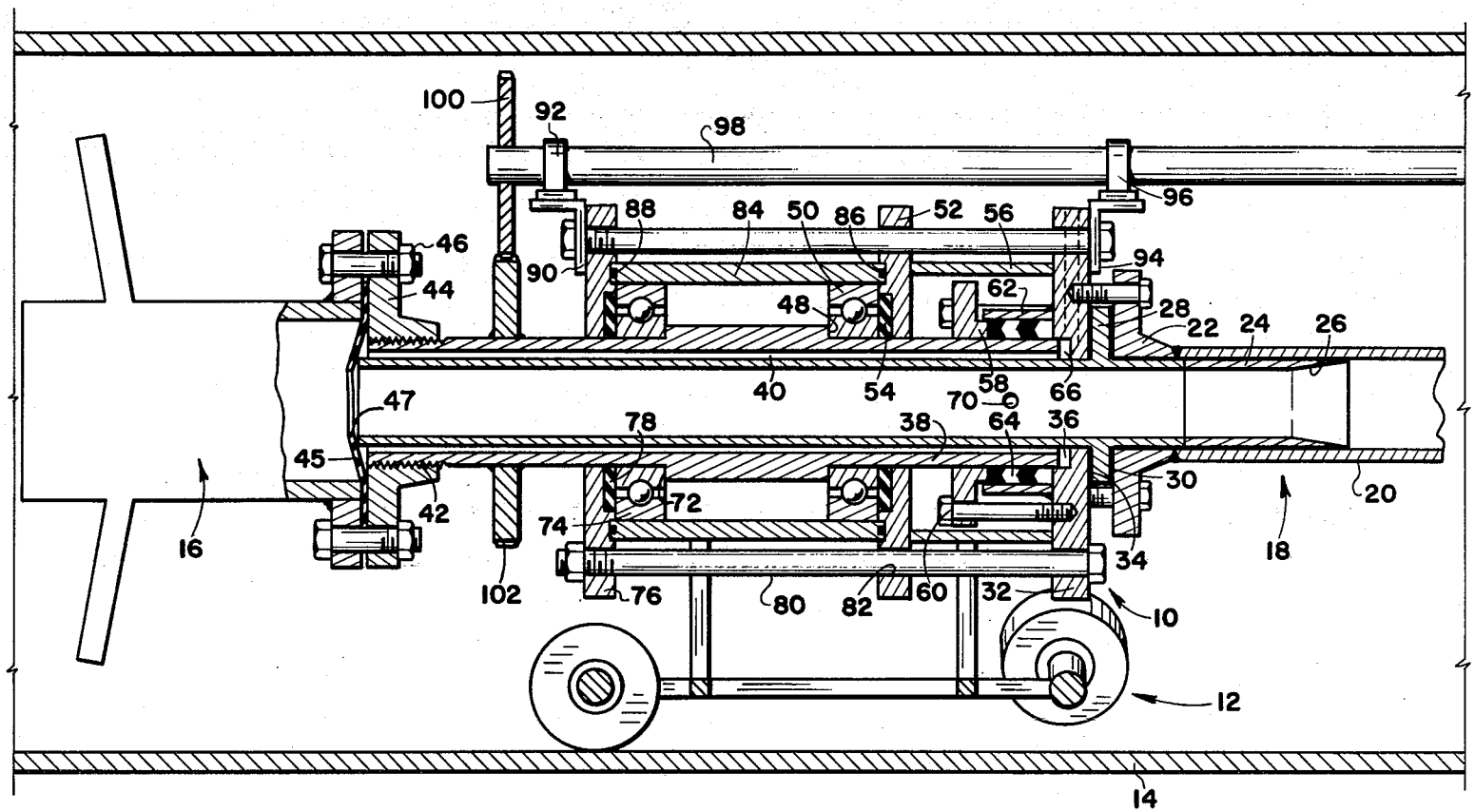
10
12
14
16
18
20
22
24
26
28
30
32
34
36
38
40
42
44
45
46
47
48
50
52
54
56
58
60
62
64
66
70
72
74
76
78
80
82
84
86
88
90
92
94
96
98
100
102

INTERNAL PIPE CLEANING APPARATUS UTILIZING FLUENT ABRASIVE

BACKGROUND OF THE INVENTION

1. Field of the Invention

This invention relates to improvements in pipe cleaning apparatus and more particularly, but not by way of limitation to an apparatus for cleaning the inner periphery of a pipe section with abrasive materials.

2. Description of the Prior Art

It is frequently necessary to clean the inner periphery of pipe for many reasons, such as to remove scale, rust, paint, or the like, accumulated within the pipeline during extended periods of storage. Considering the fact that most pipe sections are relatively long, it is extremely difficult to clean the interior walls thereof. There are many devices available today for moving longitudinally through the interior of pipe for ejecting abrasive materials radially outwardly for impinging thereof against the inner periphery of the pipe to "sand blast" the walls thereof. These devices have many disadvantages, however, in that the grit or abrasive materials used in the devices usually contacts the inner periphery of the pipe and is deflected back against the outer periphery of the jets or nozzles or other portions of the cleaning apparatus used in the blasting operation, and quickly wears away the device itself. In order to overcome this particular disadvantage, a rotating head as shown in my co-pending application Ser. No. 815,906, filed July 15, 1977, now U.S. Pat. No. 4,180,948 and entitled "Internal Pipeline Cleaning Device" was developed which directs the grit or abrasive materials against the inner periphery of the pipe in such a manner that the deflecting particles are directed away from the cleaning device itself, thus greatly increasing the overall cleaning efficiency and increasing the useful live of the device. This apparatus, however, has certain disadvantages in that the abrasive materials may leak from the distribution passageways which direct the materials to the head, thus resulting in a damage of the sealing elements of the apparatus.

SUMMARY OF THE INVENTION

The present invention contemplates a novel pipe cleaning apparatus particularly designed and constructed for substantially eliminating any leakage of the abrasive pipe cleaning materials prior to discharge of the materials from the cleaning head. The novel apparatus comprises the usual rotatable cleaning head, such as shown in my aforementioned prior application, having elongated passageway means for directing the abrasive materials to the interior of the cleaning head. A pressure chamber is provided around the outer periphery of the passageway carrying the abrasives, and is in communication with a source of air pressure, or the like, for maintaining the pressure within the chamber at least slightly greater than the pressure within the passageway means. In this manner, abrasive materials moving through the passageway means cannot escape from the passageway means prior to entry into the cleaning head. The novel apparatus is simple and efficient in operation and economical and durable in construction.

BRIEF DESCRIPTION OF THE DRAWINGS

The FIGURE is a sectional elevational view of a pipe cleaning apparatus embodying the invention, with portions broken away for purposes of illustration.

DESCRIPTION OF THE PREFERRED EMBODIMENT

Referring to the drawings in detail, reference character 10 generally indicates a pipe cleaning apparatus adapted to be supported by a suitable wheeled cart apparatus 12 for longitudinally movement through a pipe section 14 during a pipe cleaning operation, as is well known. The apparatus 10 comprises a suitable rotatable cleaning head 16 of any suitable or well known type, but preferably as shown in my aforementioned co-pending application, bolted or otherwise removably secured to one end of a materials conveying or spindle apparatus generally indicated at 18.

The apparatus 18 comprises a tube or pipe member 20 of a length generally corresponding to the overall length of the pipe section 14 and having one end thereof open to a source of sand, grit, or other abrasive material, and having a suitable flange fitting 22 welded or otherwise secured to the opposite end thereof. A tubular insert 24 has one end inserted within the flanged end of the pipe 20 for receiving the abrasive materials thereof, and the inserted end of the tube 24 is internally bevelled as shown at 26 for facilitating the passage of the abrasive materials from the interior of the tube 20 into the interior of the insert member 24 as will be hereinafter set forth in detail. The insert member 24 extends longitudinally into communication with the interior of the cleaning head 16 for directing the cleaning materials thereto during a pipe cleaning operation.

An outwardly extending circumferential shoulder 28 is provided on the outer periphery of the insert 24 and is disposed against the outer face of the flanges fitting 22. Of course, it is preferably to interpose a suitable sealing gasket 30 between the shoulder 28 and fitting 22, as is well known, for precluding leakage therebetween. An apertured plate 32 is disposed around the outer periphery of the insert 24 and disposed against the opposite side of the flange 28, and a suitable sealing gasket 34 is preferably interposed therebetween for precluding leakage, as is well known. The inner diameter of the plate 32 is enlarged as shown at 36 for receiving one end of a rotatable sleeve 38 therein. The sleeve 38 is disposed substantially concentrically around the outer periphery of the insert 24, and the inner diameter of the sleeve 38 is greater than the outer diameter of the insert 24 whereby an annulus 40 is formed therebetween. The outer end of the sleeve 38 is open as clearly shown in the drawings, and the outer periphery thereof is preferably threaded, as shown at 42 for receiving a flanged fitting 44 thereon. The cleaning head 16 is preferably secured to the fitting 44 by suitable bolts 46, for removably securing the head 16 to the apparatus 18, as hereinbefore set forth.

An annular sealing member 45 is securely clamped between the flange 42 and head 16 and is provided with a central aperture 47 having a diameter substantially equal to the inner diameter of the insert 24 for precluding interference with the passage of the abrasive material into the head 16. However, the sealing member 45 is in engagement with the outer end of the insert 24 and provides a seal between the interior of the insert 24 and the annulus 40 for a purpose as will be hereinafter set forth in detail.

An annular shoulder 48 is provided on the outer periphery of the sleeve 38 spaced from the plate 32 for receiving a suitable ball bearing member 50 thereagainst. A second apertures plate member 52 is disposed around the outer periphery of the sleeve 38 in spaced relation with respect to the plate 32 and disposed against the bearing 50, with a suitable sealing gasket 54 being preferably interposed therebetween. A cylindrical housing 56 is disposed between the inwardly directed faces of the plates 32 and 52 and is secured therebetween in any suitable manner (not shown). A flanged ring member 58 is disposed around the outer periphery of the sleeve 38 between the plates 32 and 52 and within the housing 56, and is secured in spaced relation with respect to the plate 32 by suitable bolts 60. A sleeve 62 is welded or otherwise secured to the inner face of the plate 32 and extends in a direction toward the ring 58 for providing a packing chamber or packing gland between the outer periphery of the sleeve 38 and the inner periphery of the sleeve 62. A plurality of suitable dynamic sealing members 64, preferably of the chevron type, but not limited thereto, are disposed within the packing chamber for precluding leakage.

The inner end of the sleeve 38 terminates just short of engagement with the face of the plate 32 for providing a pressure chamber or air gap 66 therebetween, and the air gap 66 is in open communication with the annulus 40. A radially extending passageway 68 is provided in the plate 32 which provides communication between a suitable source of air pressure (not shown) and the air gap 66 for providing a preselected air pressure for the annulus 40, for a purpose as will be hereinafter set forth.

Of course, it is preferably to provide a suitable grease fitting 70 in the wall of the sleeve 64 for permitting the injection of a suitable lubricant into the packing chamber as is well known. It is desirable to provide a suitable aperture (not shown) in the wall of the housing 56 in substantial alignment with the grease fitting in order to provide access therefor for assuring proper lubrication of the packing chamber without any disassembly of the apparatus 18. It is preferable that the grease fitting 70 be disposed at the side of the sleeve 62 whereby any leakage of lubricant will be contained within the housing 56 and will not contaminate the interior of the pipe 14.

A second annular shoulder 72 is provided on the outer periphery of the sleeve 38 in spaced relation with respect to the shoulder 54 for receiving a second ball bearing member 74 thereagainst. A third aperture plate 76 is disposed outboard of the bearing 72 and it is preferably to provide a suitable sealing gasket 78 therebetween the precluding leakage of fluid. The plate 76 is retained in spaced relation with respect to the plate 32 by a plurality of circumferentially spaced elongated bolts 80 which extend between the plates 76 and 32 and through complementary apertures 82 provided in the plate 52. A cylindrical housing 84 is secured between the plates 52 and 76 and around the outer periphery of the bearing 72 and 50, and suitable sealing elements 86 and 88 are interposed between the cylinder 84 and plates 52 and 76, respectively, for precluding leakage of fluid therebetween. A suitable lubricant is disposed within the cylinder 84 for assuring an efficient lubrication for the bearings during operation of the apparatus 18.

A first bracket member 90 is secured to the outboard face of the plate 76 in any suitable manner, such as by the bolts 80, and supports a first pillow block bearing 92. A second bracket member 94 is similarly secured to the outboard face of the plate 32 and supports a second pillow block bearing 96 which is disposed in substantial axial alignment with the bearing 92 for rotatably supported an elongated drive shaft 98. The drive shaft 98 is preferably at least as long as the overall length of the pipe section 14 and the outer end (not shown) of the shaft 98 is operable connection with a suitable drive motor (not shown) which rotates the shaft about its open longitudinal axis. The inner end of the shaft 98 extends beyond the bearing 92 and is provided with a spur gear 100 which is keyed or otherwise secured thereto for rotation simultaneously therewith. A mating gear 102 is secured to the outer periphery of the sleeve 38 for transmitting rotation thereto upon rotation of the gear 100 with the drive shaft 98.

In use, the apparatus 18, having the cleaning head 16 mounted therein, is initially inserted into the interior of the pipe 14 through one end thereof, and is moved longitudinally through the pipe during the pipe cleaning operation by the cart 12 in any well known manner. The drive motor (not shown) is activated for rotating the drive shaft 98 whereby rotating is transmitted to the sleeve 38 through the gears 100 and 102. Of course, the rotation of the sleeve 38 is transmitted to the head 16 through the connection of the flange 44 with the head.

As the apparatus 18 is moved through the pipe 14, a supply of suitable cleaning material, such as sand, grit, or other abrasive materials, is admitted into the interior of the tube 20 through the open outer end thereof (not shown), and the abrasive material is maintained at a relatively high pressure in any well known manner whereby the grit is discharged from the cleaning head 16 with sufficient force for an efficient cleaning of the inner periphery of the pipe 14. The grit enters the insert member 24 at the bevelled end 26 thereof, and the bevel 26 provides a smooth entry of the material into the insert in that there is no inwardly extending projection in the interior of the pipe at the juncture between the insert 24 and tube 20, thus eliminating any eddy currents, or the like, which might otherwise occur within the apparatus 18.

Air under pressure from any suitable source of supply (not shown) is admitted into the passageway 68 and fills the air gap 66 and annulus 40. Whereas any air pressure which is in excess of the pressure within the interior of the insert 24 will provide an efficient operation, it is preferable that the pressure maintained within the annulus 40 be approximately 20 p.s.i. greater than the internal pressure of the insert 24. In this manner, there is a positive sealing of the abrasive material from the seals of the apparatus 18, thus greatly increasing the operating efficiency and life expectancy of the apparatus.

From the foregoing it will be apparent that the present invention provides a novel apparatus for cleaning the interior of a pipe section through the use of abrasive materials impinging against the inner periphery of the pipe. The novel apparatus provides a passageway for communication abrasive materials to a cleaning head, and provides an air seal interposed between the abrasive material and the sealing elements of the apparatus, thus greatly increasing the operating efficiency and useful life of the apparatus.

Whereas the present invention has been described in particular relation to the drawings attached hereto, it should be understood that other and further modifications, apart from those shown or suggested herein may be made within the spirit and scope of this invention.

What is claimed is:

1. An apparatus for cleaning the interior of pipe sections and comprising a rotatable cleaning head, spindle means secured to the cleaning head, said spindle means including a non-rotatable passageway means for directing abrasive materials to the cleaning head for impinging thereof against the inner periphery of the pipe during a cleaning operation, rotatable means supported by the non-rotatable passageway means for transmitting rotation to the cleaning head, seal means interposed between the rotating means and the non-rotating passageway means for precluding leakage therebetween, air pressure sealing means interposed between the passageway means and seal means for precluding contact of the abrasive materials with the seal means, and wherein the rotatable means comprises a sleeve member secured to the cleaning head and concentrically arranged around the outer periphery of the insert means and rotatable with respect thereto, bearing housing means supported by the insert means, sealing means interposed between the sleeve member and bearing housing means for precluding leakage of fluid therebetween, air gap means provided in said bearing housing means and in open communication with the annulus between the sleeve member and insert means, passageway means provided in said bearing housing means in communication with the air gap means for directing fluid pressure thereto whereby the pressure within the air gap means and a-nulus is greater than the internal pressure within the insert means during a pipe cleaning operation.

2. An apparatus as set forth in claim 1 wherein the non-rotatable passageway means comprises tube means having one end open to a source of abrasive material, insert means having a first end open to the interior of the tube means and a second end open to the interior of the cleaning head for directing the abrasive material from the tube means to the cleaning head.

3. An apparatus as set forth in claim 2 wherein the first end of the insert means is internally beveled for precluding internal turbulence in the flow of the abrasive materials passing through the insert means.

4. An apparatus as set forth in claim 1 and including drive shaft means supported by the bearing housing means, and gear means interposed between the drive shaft means and the sleeve member for transmitting rotation to the sleeve member during a pipe cleaning operation.

5. An apparatus as set forth in claim 1 wherein the bearing housing means comprises an outer housing having at least two internal chambers provided therein, bearing members disposed in one of said chambers and interposed between the housing and the sleeve member, and packing gland means provided in the other of said chambers and interposed between the housing and the air gap for precluding leakage of fluid therebetween.

6. An apparatus as set forth in claim 1 and including sealing gasket means interposed between the sleeve member and the cleaning head for closing one end of said annulus for precluding flow of material from the interior of the insert means and cleaning head into the annulus during a pipe cleaning operation.

* * * * *